United States Patent [19]

Kotulla et al.

[11] Patent Number: 4,501,516

[45] Date of Patent: Feb. 26, 1985

[54] ANCHORING OF TENSION MEMBERS

[75] Inventors: Bernhard Kotulla; Martin Weiser, both of Cologne; Jürgen Faltin, Roesrath; Lothar Preis, Cologne; Rudolf Schmidt, Burscheid; Eberhard Born, Cologne, all of Fed. Rep. of Germany

[73] Assignee: Bayer Aktiengesellschaft, Leverkusen, Fed. Rep. of Germany

[21] Appl. No.: 548,741

[22] Filed: Nov. 4, 1983

Related U.S. Application Data

[60] Division of Ser. No. 340,417, Jan. 18, 1982, Pat. No. 4,443,132, which is a continuation of Ser. No. 048,298, Jun. 13, 1979, abandoned.

[30] Foreign Application Priority Data

Jun. 22, 1978 [DE] Fed. Rep. of Germany ..... 2827327

[51] Int. Cl.[3] ..... E21D 20/02

[52] U.S. Cl. ..... 405/260

[58] Field of Search ..... 405/259, 260, 261, 262

[56] References Cited

U.S. PATENT DOCUMENTS

| | | | |
|---|---|---|---|
| 2,930,199 | 3/1960 | Jarund | 405/260 |
| 3,306,051 | 2/1967 | Howlett | 405/260 |
| 3,494,134 | 2/1970 | Jorge | 405/260 |

*Primary Examiner*—David H. Corbin

*Attorney, Agent, or Firm*—Sprung, Horn, Kramer & Woods

[57] ABSTRACT

By using a packer which is pushed as far over an anchor as the intended length of the moulding, the cavity in a borehole in the region of the bond can be completely filled with a reactive resin. Overhead work is possible even with slowly reacting resins. By using a catalyst on the packer, the reactive resin injected into the borehole behind the packer can be made to harden very rapidly.

2 Claims, 5 Drawing Figures

ANCHORING OF TENSION MEMBERS

This is a division of application Ser. No. 340,417 filed Jan. 18, 1982, now U.S. Pat. No. 4,443,132 which is a continuation of application Ser. No. 048,298, filed June 13, 1979 and now abandoned.

BACKGROUND OF THE INVENTION

This invention relates to a process whereby an anchor which can be pre-stressed and re-tightened is fixed into a hole in rock.

The fitting of earth and rock anchors into a borehole in such a way as to leave no gap between the tension member and the borehole is possible only by injection moulding. In anchors produced in this way, in which the tension members are generally made of steel, the risk of corrosion is high. Cracks may occur in the injection moulded body due to excessive localised tension and changes in length may occur in the event of shifting of the ground. The tension member is then very liable to be attacked by corrosion in this region. With the known adhesive cartridges it is impossible to assess accurately the length to which the force is introduced. When systems containing filler are used in these cartridges, it is frequently impossible to obtain a homogeneous mixture. Anchoring overhead, as when a tension member has to be fixed to a roof, is then particularly unreliable. Very active adhesive systems must then be used, but these do not have the necessary high quality bonding properties. When hydraulic mortar is used for injection moulding, a major proportion of it is first injected and is then partly rinsed off so that a part of the tension member is again exposed. This is a very expensive process.

SUMMARY OF THE INVENTION

It is an object of the present invention to provide a simple process for anchoring tensile tension members in rock. The tension members should be made of high tensile materials and the anchors must therefore be capable of taking up high loads. In addition to a rational method of fixing the tension members in the borehole, it is above all desired to ensure that the anchor will be securely fixed even overhead. To solve this problem in accordance with the invention, the tension member is pushed into the borehole with a packer which is as far removed from the end as the intended length of injection moulding, and a reactive resin is injected into the borehole behind the packer. Other advantageous features of the process are described herein.

DETAILED DESCRIPTION OF THE INVENTION

The packer on the tension member enables the previously determined length of bonding to be accurately observed. The cavity in the region of the bonding is completely filled, regardless of the condition of the borehole. Since the injected reaction mixture is produced outside the borehole under controlled conditions, any desired composition can be prepared with sufficient homogeneity. A wide range of reaction resins is available, in particular epoxide, polyester and polyurethane resins.

Figure 1:
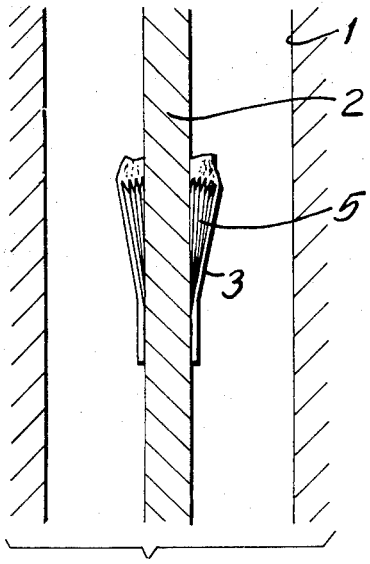
FIG. 1 is a partial sectional view of an anchor being inserted into a borehole according to the present invention.
Figure 2:
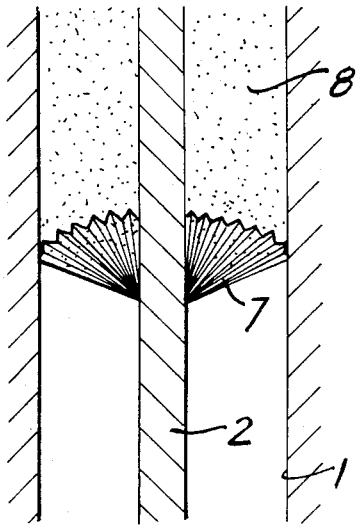
FIG. 2 is a partial sectional view of the anchor of FIG. 1 after injection of resin according to the present invention.
Figure 3:
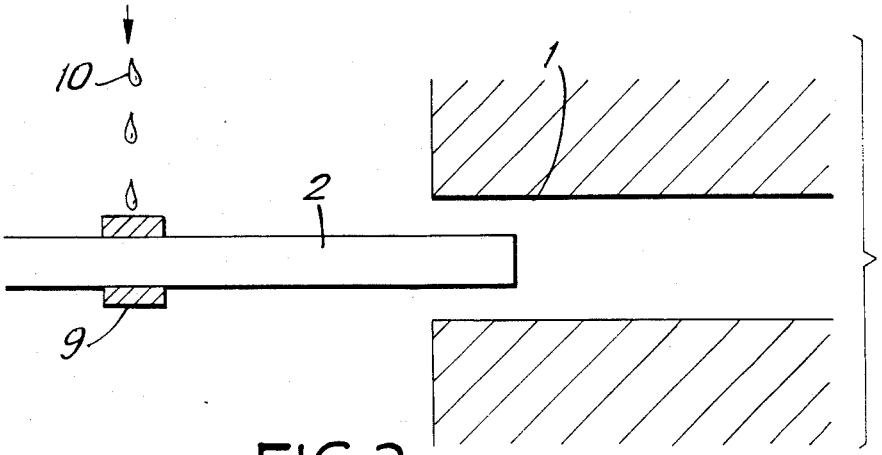
FIG. 3 is a sectional view of another embodiment of an anchor according to the present invention.
Figure 4:
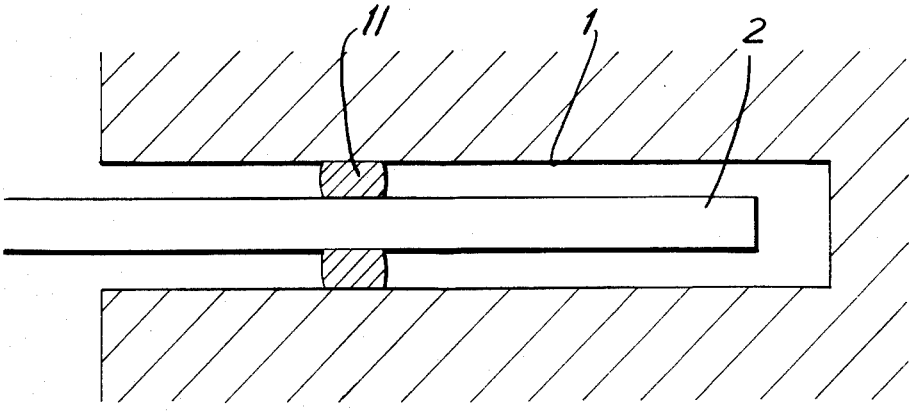
FIG. 4 is a sectional view of an anchor of FIG. 3 after insertion in the borehole.

Referring now to FIGS. 1–5, the packer in the anchoring region of the tension member may have various forms, for example it may have the form of a sleeve or pleated sheath. As shown in FIG. 1, a pleated sheath 5 is fixed to the tension member 2 by a compression joint or a clamp (not shown). As the tension member 2 is introduced into the borehole 1, the pleated sheath can be pressed over the surface of the anchor with the aid of a stocking of foil or coarse-meshed fabric 3 so that the introduction of the tension member is not obstructed by the packer. The foil or fabric may be provided with a prepared line of separation where it is required to be broken off or otherwise rendered ineffective. The pressure on the pleated sheath is thereby released and the pleated sheath tends to resume its original form 7 as shown in FIG. 2. Setting up of the pleated sheath can also be facilitated by briefly pulling back the tension member. The pleated sheath fixes the tension member in the centre of the borehole. The anchor is thereby secured in the suspended position so that it will not drop out or shift out of position and resin 8 may then be injected behind same. The pleated sheath is by its nature capable of taking up high compression pressures. The material of the pleated sheath should be sufficiently elastic so that after the release of pressure the pleated sheath is automatically set upright within the annular gap. The materials used are preferably thermoplasts, elastomers or polyurethanes, which may or may not be foamed. To reinforce the elastic properties, internally situated rings or spirals of the pleated sheath may be built up of a stocking-like, coarse-meshed elastic fabric which is highly stretchable. When the pressure on the pleated sheath is released due to destruction of the driving foil or fabric, the pleated sheath is pulled together in the longitudinal direction by the stocking-like internal fabric so that the annular gap becomes completely filled. As shown in FIGS. 3 and 4, the packer may also be pushed over the anchor in the form of a sleeve 9, which may be of cellulose, e.g. in the form of a corrugated sheet of fleece. A considerable increase in volume can be obtained by filling with a foamable mixture of isocyanate-impregnated montmorrillonite or with a quick-setting hydrophilic gypsum. The annular gap between the anchor and the wall of the borehole is thereby quickly completely filled so that the anchor is again fixed and incapable of shifting or slipping in the hanging position. Shortly before the anchor is set, the packer in the form of a sleeve contained in the moisture-proof wrapping, is pushed over the anchor and fixed. The wrapping is removed and the sleeve is impregnated with water 10 and the anchor is set as shown at 11 in FIG. 4. This reaction can be controlled within wide limits as to starting time and progress. For example the reaction which increases the volume of the packer is induced before the packer is installed and the packer hardens soon thereafter. The material used for the tension member may be either steel or a fibre reinforced plastics material. Since the anchor rods need not be turned into the boreholes, thin tension member with low torsional stress made of unidirectional glass fibre reinforced plastics materials may be used.

A reactive resin of low activity may be used. Slow hardening results in exceptionally high qualities of bonding. Overhead working can also be carried out with slowly reacting resins.

Figure 5:
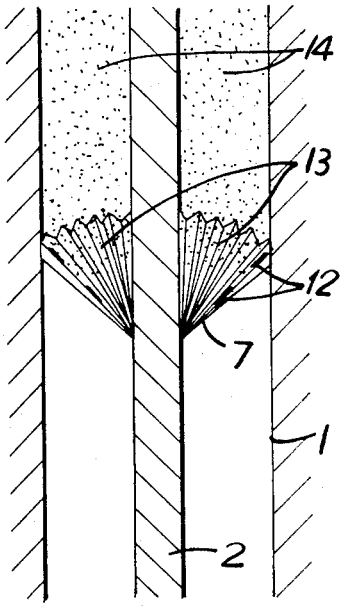
FIG. 5 is a partial sectional view of another embodiment according to the present invention.

There are several preferred variations in the use of the packer. As shown in FIG. 5, the packer may be coated with a stabilizer 12 so that the injected resins 13 which make direct contact with the packer harden very rapidly and thus build up a wall for the resin 14 subsequently injected into the deepest part of the borehole. For example, epoxide resins which are hardened with aliphatic polyamines may be strongly activated with tertiary amines, acids and acid chlorides. The rapid hardening of polyurethane resins can be greatly accelerated with, for example, tertiary amines, sila-amines, alkali metal hydroxides or organic metal compounds. Polyester resin systems may also be activated with amine and metal salt accelerators. This ensures the use of reactive resins of low activity even for those anchoring systems where the borehole extends upwards into rock.

There are two methods available for introducing the reaction mixture into the deepest part of the borehole. A tube may be pushed in together with the body of the anchor so that when the anchor is in position the tube extends beyond the packer into the deepest part of the borehole, and the reactive resin may be injected through this tube. In many cases, however, it will be possible to inject the reactive resin through the interior of the tension member.

Both temporary and permanent anchors can be produced by this process. It is preferred to produce anchors having tension members made of glass fibre reinforced resins. These anchors are distinguished by their ease of handling and high resistance to corrosion, and can easily be destroyed in the course of subsequent building work. Although considerable paths of elongation are necessary for pre-stressing due to the comparatively low E-modulus, the losses in tensional force are correspondingly less than in steel. By virtue of the low E-modulus, very long anchors can be installed without coupling joints even under restricted space conditions. Preferred applications for the anchoring of the invention are in the field of temporary and permanent anchors for securing rock and for securing pits in coal and ore mining.

We claim:

1. In a process for securing an anchor which can be pre-stressed and retightened in a borehole in rock, wherein a tension member is glued in the borehole by a reactive resin, the improvement wherein: the tension member is pushed with a packer comprising a pleated sheath into the borehole which is spaced from the end of the tension member in the borehole by a length corresponding to the length of the portion of the tension member to be glued; the packer is covered during the pushing of the tension member into the borehole to press it on the tension member; the cover is removed after the pushing step; and thereafter a reactive resin is injected into the borehole behind the packer.

2. The process according to claim 1, wherein the packer is coated with a substance which effects the rapid hardening of the injected resin coming into contact therewith due to a catalytic resin of the packer.

* * * * *